United States Patent [19]

Northrup

[11] 3,983,441

[45] Sept. 28, 1976

[54] MULTIPLE PINCH INCANDESCENT LAMP

[75] Inventor: Karl A. Northrup, Rochester, N.Y.

[73] Assignee: Xerox Corporation, Stamford, Conn.

[22] Filed: July 3, 1975

[21] Appl. No.: 592,840

[52] U.S. Cl. ..... 313/222; 313/220; 313/279; 313/273

[51] Int. Cl.[2] ..... H01K 1/28; H01K 3/02

[58] Field of Search ..... 313/222, 215, 315, 317, 313/316, 205, 273, 279, 220

[56] References Cited

UNITED STATES PATENTS

| | | | |
|---|---|---|---|
| 2,042,963 | 6/1936 | Rentschler et al. | 176/1 |
| 2,064,354 | 12/1936 | Prouty | 176/122 |
| 3,039,015 | 6/1962 | Jolly | 313/279 |
| 3,140,417 | 6/1964 | Tietze | 313/256 |

*Primary Examiner*—R. V. Rolinec
*Assistant Examiner*—Vincent J. Sunderdick
*Attorney, Agent, or Firm*—Robert J. Bird

[57] ABSTRACT

An incandescent lamp such as a tungsten filament lamp in which the filament is a series of alternate active coil sections and inactive straight sections. The surrounding glass envelope is correspondingly drawn down around the straight sections to reduce the volume of the envelope and to provide mechanical support for the filament.

4 Claims, 1 Drawing Figure

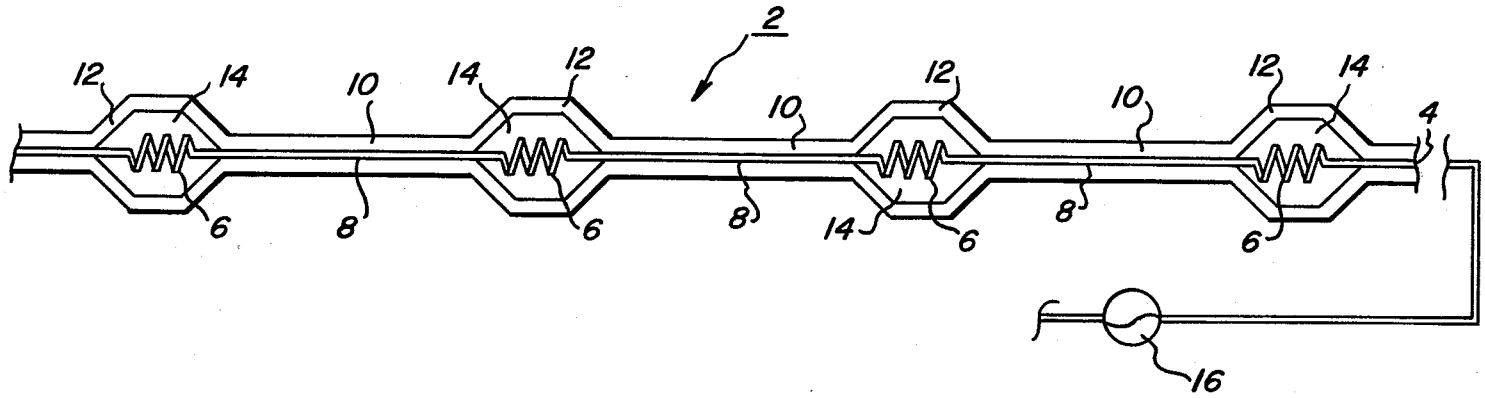
4
14
12
6
10
8
16
2

MULTIPLE PINCH INCANDESCENT LAMP

BACKGROUND OF THE INVENTION

This invention relates to incandescent lamps in which a filament of wire such as tungsten is heated to incandescence by electric current. Typically, such lamps have a filament, which is a generally continuous coil from end to end, disposed in an envelope such as glass in some form of continuous cavity around the filament.

For certain applications, a problem with such sources has been the inability to construct a linear coil to operate at a high color temperature with a relatively low power. High color temperature sources, 2800° – 3100°K, are required for acceptable efficiencies when used with visible responding systems, i.e. systems wherein there is a desired response to visible light as for example in a photocopying environment. To operate at these temperatures requires the use of a halogen cycle to prevent tube blackening and, in conventional lamps the lower limit of power required to maintain a functioning halogen cycle is approximately 150 watts per inch.

It is desired, and an object of this invention, to provide such a lamp which is operative at power levels on the order of 10 to 20 watts per inch. Ordinarily with this little power dissipated within the lamp, the temperature would not be sufficient to maintain the require halogen cycle.

SUMMARY OF THE INVENTION

This invention is practiced in one form by a filament type lamp in which the filament is a series of alternate active coil sections and inactive straight sections with the surrounding glass envelope correspondingly drawn down around the inactive sections to reduce the volume of the envelope and to provide mechanical support for the filament.

For a better understanding of this invention, reference is made to the following more detailed description of an exemplary embodiment given in connection with the accompanying drawing.

DRAWING

The single drawing figure is a somewhat schematic cross-sectional view of a filament lamp constructed according to this invention.

DESCRIPTION

With reference now to the drawing, a tungsten filament lamp is generally indicated at 2 and includes a tungsten filament 4 which in turn includes a series of active coil sections 6 separated by inactive straight sections 8. Filament 4 is operatively connected to a source of electrical energy, represented at 16.

A glass enevelope 10 surrounds the filament 4 along its length and follows its contours. That is, the glass envelope 10 is pinched or drawn down around the straight inactive sections 8 of the filament 4, and is in the form of a bulb 12 defining a cavity 14 around each of the coil sections 6. Cavities 14 contain one of the halogens, preferably bromine or iodine.

A tungsten element operating at the higher temperatures suffers from rapid deterioration due to the evaporation of tungsten. The results of this evaporation are a weakening of the coil and blackening of the bulb wal. To prevent this occurrence, the halogen iodine or bromine is added, and the bulb wall temperature is allowed to increase by reconstructing the lamp as compared to the prior art to provide a higher power dissipation in a given volume. The evaporated tungsten combines with the halogen vapor at temperatures exceeding 250°C forming tungsten halide gas which diffuses back to the filament. (A bulb wall temperature of 600°C is usually desired for efficient operation.) The high filament temperature decomposes the tungsten halide and free tungsten is released and redeposited on the filament.

The requirement for relatively high bulb wall temperatures is one of the problems encountered in the construction of low power tungsten halogen lamps. The required lamp for one system, having only 200 watts dissipated over a 15-inch length, would have difficulty in maintaining the required bulb wall temperature for an efficient halogen regenerative cycle.

By having cavities 14 only at the coils 6, and not around the straight sections 8 of the filament, the volume within the envelope 10 is kept at a practical minimum. This minimum volume enhances temperature buildup during operation to maintain the required halogen cycle. An infrared reflective coating may be used on the bulb sections 12 to further enhance temperature buildup and maintenance within the cavities 14.

An additional feature of this arrangement is that drawing the envelope down over the straight sections 8 of the filament provides mechanical support for the filament and insures its proper optical alignment with respect to the lamp mounting.

The foregoing description of this invention is given by way of illustration and not of limitation. The concept and scope of the invention are limited only by the following claims and equivalents thereof.

What is claimed is:

1. An incandescent filament lamp including:

a filament operatively connected to a source of electrical energy, said filament including a series of alternate active coil sections and inactive straight sections, an envelope disposed around said filament along its length, said envelope being drawn down around said filament along said straight sections thereof to accurately position and support said filament and to reduce the volume within said envelope, said envelope defining cavities about said coil sections for the incandescent operation therein of said coil sections.

2. A lamp as defined in claim 1 in which said envelope further includes a quantity of bromine.

3. A lamp as defined in claim 1 in which said envelope further includes a quantity of iodine.

4. An incandescent tungsten filament lamp including:

a tungsten filament operatively connected to a source of electrical energy, said filament including a series of alternate active coil sections and inactive straight sections, an envelope disposed around said filament along its length, said envelope being drawn down around said filament along said straight sections thereof to accurately position and support said filament and to reduce the volume within said envelope, said envelope defining cavities about said coil sections for the incandescent operation therein of said coil sections, said envelope containing a halogen from the group consisting of bromine and iodine, whereby gaseous halogen and tungsten vapor are generated under the influence of operating temperature of said lamp, and combine to form a tungsten halide gas which diffuses in a regenerative cycle, back to said filament.

* * * * *